US008353323B2

(12) United States Patent
Schumacher et al.

(10) Patent No.: US 8,353,323 B2
(45) Date of Patent: Jan. 15, 2013

(54) SHARPENER WITH AUTOSTOP FEATURE

(75) Inventors: Michael Schumacher, Hilliard, OH (US); Ben Dunlap, Statesville, NC (US); Theo Muir, Columbus, OH (US)

(73) Assignee: Elmer's Products, Inc., Westerville, OH (US)

( * ) Notice: Subject to any disclaimer, the term of this patent is extended or adjusted under 35 U.S.C. 154(b) by 120 days.

(21) Appl. No.: 12/826,041

(22) Filed: Jun. 29, 2010

(65) Prior Publication Data

US 2010/0326568 A1 Dec. 30, 2010

Related U.S. Application Data

(60) Provisional application No. 61/221,221, filed on Jun. 29, 2009.

(51) Int. Cl.
*B43L 23/00* (2006.01)

(52) U.S. Cl. ..... 144/28.1; 144/28.5; 144/28.72

(58) Field of Classification Search ..... 144/28.1–28.9
See application file for complete search history.

(56) References Cited

U.S. PATENT DOCUMENTS 3,678,975 A * 7/1972 Imanishi et al. ..... 144/28.5
3,777,791 A * 12/1973 Uchida ..... 144/28.72
6,470,929 B2 10/2002 Fregeolle
7,134,461 B2 11/2006 Takada
7,240,703 B2 7/2007 Hu
7,273,079 B2 9/2007 Kok
7,455,087 B2 11/2008 Mak et al.
7,472,728 B1 * 1/2009 Geffen ..... 144/28.5
7,913,731 B2 * 3/2011 Sued et al. ..... 144/356

FOREIGN PATENT DOCUMENTS

CA 2378548 A1 9/2002
CA 2378548 C 11/2006

* cited by examiner

*Primary Examiner* — Bena Miller
(74) *Attorney, Agent, or Firm* — McNees Wallace & Nurick, LLC

(57) ABSTRACT

An electric pencil sharpener comprising a motor; a cutter assembly operatively connected to the motor, wherein the cutter assembly further includes: a conical housing defining a conical cavity therein for receiving a pencil; and at least one rotary blade mounted in close proximity to the conical cavity, wherein the at least one rotary blade further includes spiral cutting edges for sharpening the pencil; a switch assembly positioned at the narrow end of the conical housing, wherein the switch assembly further includes: a shutoff switch operative to deactivate the motor; mechanical means for actuating the shutoff switch when a desired degree of sharpening has been achieved by the cutter assembly; and an electronic control unit in electrical communication with the switch assembly and the motor, wherein the electronic control unit is operative to provide a delay of a predetermined period of time between when the shutoff switch is activated and when the motor is deactivated.

20 Claims, 7 Drawing Sheets

SHARPENER WITH AUTOSTOP FEATURE

CROSS-REFERENCE TO RELATED APPLICATIONS

This patent application claims the benefit of U.S. Provisional Patent Application Ser. No. 61/221,221 filed on Jun. 29, 2009 and entitled "Sharpener with Autostop Feature," the disclosure of which is hereby incorporated by reference herein in its entirety and made part of the present U.S. utility patent application for all purposes.

BACKGROUND OF THE INVENTION

The present invention relates generally to pencil sharpeners, and more specifically to a pencil sharpener that includes an automatic stop (i.e., shut off) feature.

Manually operated and electrically powered pencil sharpeners are commonplace in modern society. When a pencil is inserted through a pencil-receiving opening of a pencil sharpener's housing, the pencil enters a sharpening assembly which cuts an outer layer of wood to expose and sharpen an inner core of lead or graphite. Some manual pencil sharpeners include a selector guide. The selector guide typically includes several openings sized to correspond to pencils of different thicknesses, for example, a standard adult size or a larger diameter child size pencil. The various openings of the selector guide are positionable in alignment with the pencil-receiving opening. The selector guide maintains proper alignment of the pencil with the sharpening assembly during the sharpening process.

Various configurations of electrically powered pencil sharpeners are known. A common electric pencil sharpener has a sharpening assembly that includes a rotary means rotatable by a motor and cutter means operatively carried by the rotary means so as to rotate in a direction opposite to a rotational direction of the rotary means. While such pencil sharpeners are easy to use, they can quickly cause excess wear and waste of the pencil, i.e., by oversharpening. This problem is particularly acute with children lacking experience, judgment, and/or adequate hand/eye coordination. Accordingly, some electric pencil sharpeners include a self-governing sharpening assembly having a mechanism for preventing excess oversharpening of a pencil.

Many sharpeners utilize pencil tip stops that give the user feedback in the form of increased resistance and a change in pitch of the motor. However, these stops are sometimes difficult to sense, especially for children. Other pencil sharpeners on the market include a more advanced feature known as a "fly-away" cutter that mechanically disengages the cutter when the sharpened pencil tip contacts a plate at the very end of the pencil-receiving bore. This type of mechanism prevents over-sharpening and provides a more distinct "stop" and change in pitch of the motor. However, a significant disadvantage of this system is that it is not well understood by many users of such systems. Users sometimes attribute the disengaged cutters to a malfunction in the sharpener since the motor remains running even after sharpening has ceased. Additionally, because the motor keeps running the sharpener continues to produce unwanted noise, which is problematic in the office and classroom environments. Other pencil sharpeners include visual indicators to inform the user that sharpening process is complete. A common implementation is to place an electrical switch where it can be actuated from a mechanical pencil-tip contact plate. This type of design requires precise mechanical tolerances for effective operation. If the switch is actuated too early, the indicator will illuminate before sharpening is complete and if the switch mechanism is placed too far back in the pencil bore, it may not function at all.

Considering the above-listed complexities and problems with commercially available pencil sharpeners, there is an ongoing need for an electric pencil sharpener that prevents oversharpening of pencils, but that does so in a consistent and reliable manner and that does not require overly complex devices or difficult to understand systems of operation.

SUMMARY OF THE INVENTION

The following provides a summary of certain exemplary embodiments of the present invention. This summary is not an extensive overview and is not intended to identify key or critical aspects or elements of the present invention or to delineate its scope.

In accordance with one aspect of the present invention, an electric pencil sharpener is provided. This pencil sharpener includes a motor; a cutter assembly, wherein the cutter assembly is operatively connected to the motor, and wherein the cutter assembly further includes: a conical housing defining a conical cavity therein for receiving a pencil in need of sharpening; and at least one rotary blade mounted in close proximity to the conical cavity, wherein the at least one rotary blade further includes spiral cutting edges for sharpening the pencil; a switch assembly positioned at the narrow end of the conical housing of the cutter assembly, wherein the switch assembly further includes: a shutoff switch operative to deactivate the motor; and mechanical means for actuating the shutoff switch when a desired degree of sharpening of the pencil has been achieved by the cutter assembly; and an electronic control unit in electrical communication with the switch assembly and the motor, wherein the electronic control unit is operative to provide a delay of a predetermined period of time between when the shutoff switch is actuated and when the motor is deactivated.

In accordance with another aspect of the present invention, an electric pencil sharpener is provided. This electric pencil sharpener includes a motor; a cutter assembly, wherein the cutter assembly is operatively connected to the motor, and wherein the cutter assembly further includes: a conical housing defining a conical cavity therein for receiving a pencil in need of sharpening; and at least one rotary blade mounted in close proximity to the conical cavity, wherein the at least one rotary blade further includes spiral cutting edges for sharpening the pencil; a first switch assembly positioned at the narrow end of the conical housing of the cutter assembly, wherein the first switch assembly further includes: a shutoff switch operative to deactivate the motor; and mechanical means for actuating the shutoff switch when a desired degree of sharpening of the pencil has been achieved by the cutter assembly; an electronic control unit in electrical communication with the first switch assembly and the motor, wherein the electronic control unit is operative to provide a delay of a predetermined period of time between when the shutoff switch is actuated and when the motor is deactivated; and a second switch assembly in electrical communication with the electronic control unit, wherein the second switch assembly is operative to engage a pencil inserted into the conical housing and activate the motor.

In yet another aspect of this invention, an electric pencil sharpener is provided. This electric pencil sharpener includes a motor; a cutter assembly, wherein the cutter assembly is operatively connected to the motor, and wherein the cutter assembly further includes: a conical housing defining a conical cavity therein for receiving a pencil in need of sharpening;

at least one rotary blade mounted in close proximity to the conical cavity, wherein the at least one rotary blade further includes spiral cutting edges for sharpening the pencil; and a fly-away mechanism for disengaging the at least one rotary blade from the pencil being sharpened; and a first switch assembly positioned at the narrow end of the conical housing of the cutter assembly, wherein the switch assembly further includes: a shutoff switch operative to activate the fly-away mechanism and deactivate the motor; mechanical means for actuating the shutoff switch when a desired degree of sharpening of the pencil has been achieved by the cutter assembly; and an electronic control unit in electrical communication with the first switch assembly and the motor, wherein the electronic control unit is operative to provide a delay of a predetermined period of time between when the shutoff switch is actuated and when the motor is deactivated; and a second switch assembly in electrical communication with the electronic control unit, wherein the second switch assembly is operative to engage a pencil inserted into the conical housing and activate the motor.

Additional features and aspects of the present invention will become apparent to those of ordinary skill in the art upon reading and understanding the following detailed description of the exemplary embodiments. As will be appreciated by the skilled artisan, further embodiments of the invention are possible without departing from the scope and spirit of the invention. Accordingly, the drawings and associated descriptions are to be regarded as illustrative and not restrictive in nature.

BRIEF DESCRIPTION OF THE DRAWINGS

The accompanying drawings, which are incorporated into and form a part of the specification, schematically illustrate one or more exemplary embodiments of the invention and, together with the general description given above and detailed description given below, serve to explain the principles of the invention, and wherein.

DETAILED DESCRIPTION OF THE INVENTION

Figure 1:
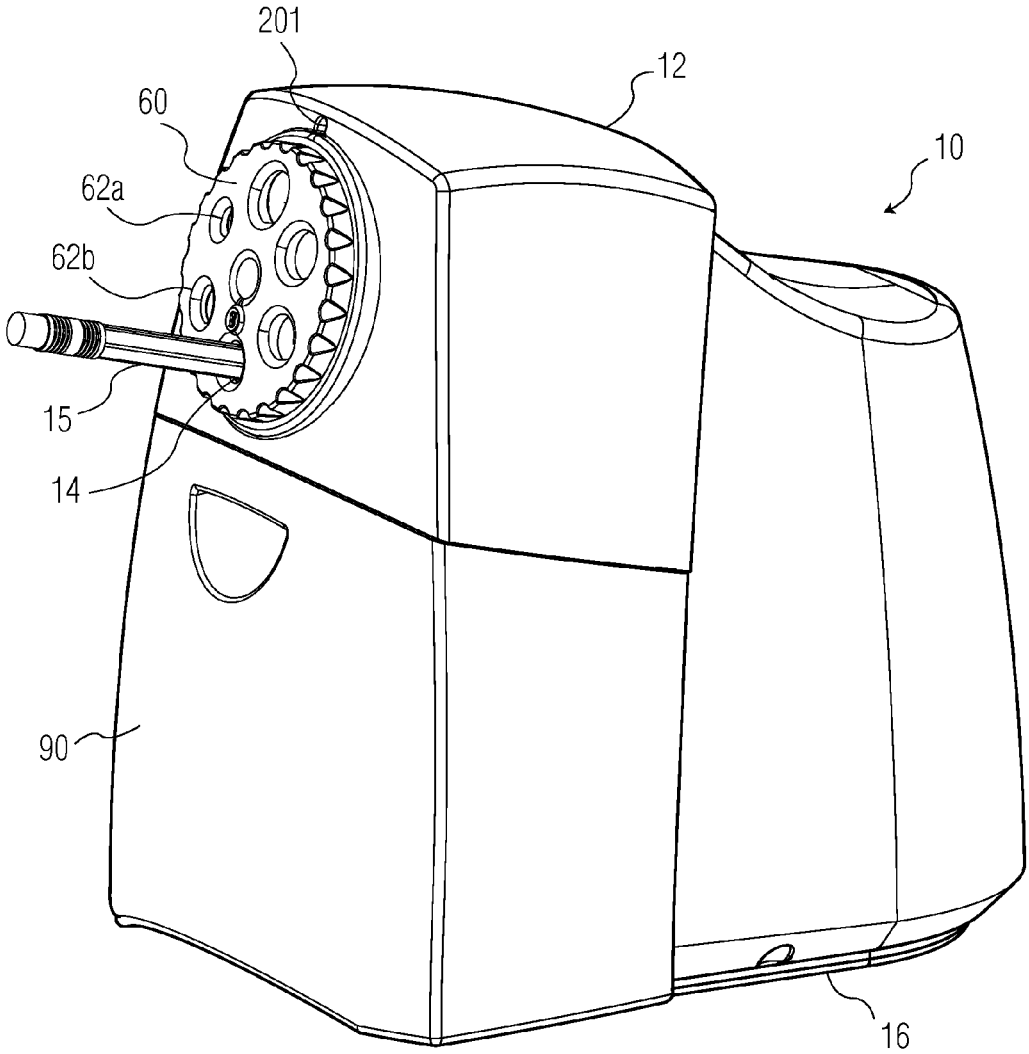
FIG. 1 is a front perspective view of an exemplary embodiment of an electrical pencil sharpener in accordance with the present invention.

Exemplary embodiments of the present invention are now described with reference to the Figures. Reference numerals are used throughout the detailed description to refer to the various elements and structures. In other instances, well-known structures and devices are shown in block diagram form for purposes of simplifying the description. Although the following detailed description contains many specifics for the purposes of illustration, a person of ordinary skill in the art will appreciate that many variations and alterations to the following details are within the scope of the invention. Accordingly, the following embodiments of the invention are set forth without any loss of generality to, and without imposing limitations upon, the claimed invention.

The present invention relates to an electric pencil sharpener that includes features for preventing the oversharpening of a pencil or similar item (i.e., a cosmetics item). In one or more exemplary embodiments, the features for preventing oversharpening include a fly-way cutter mechanism and an autostop mechanism for defeating the motor. When a desired pencil point is achieved, the cutter system will stop rotating and cutting into the wood of the pencil, the motor will stop, and an LED will illuminate to indicate that the sharpening process is complete. Once the LED turns off, the sharpener is ready to receive another pencil for sharpening. This system prevents over-sharpening of the pencil and provides for an ideal and safe point size pencil tip. A number of the basic electrical and mechanical aspects of the present invention are disclosed in U.S. Pat. No. 6,470,929 to Fregeolle (2002), which is incorporated by reference herein in its entirety for all purposes. Referring now to the Figures, one or more specific embodiments of this invention shall be described in greater detail.

Figure 2:
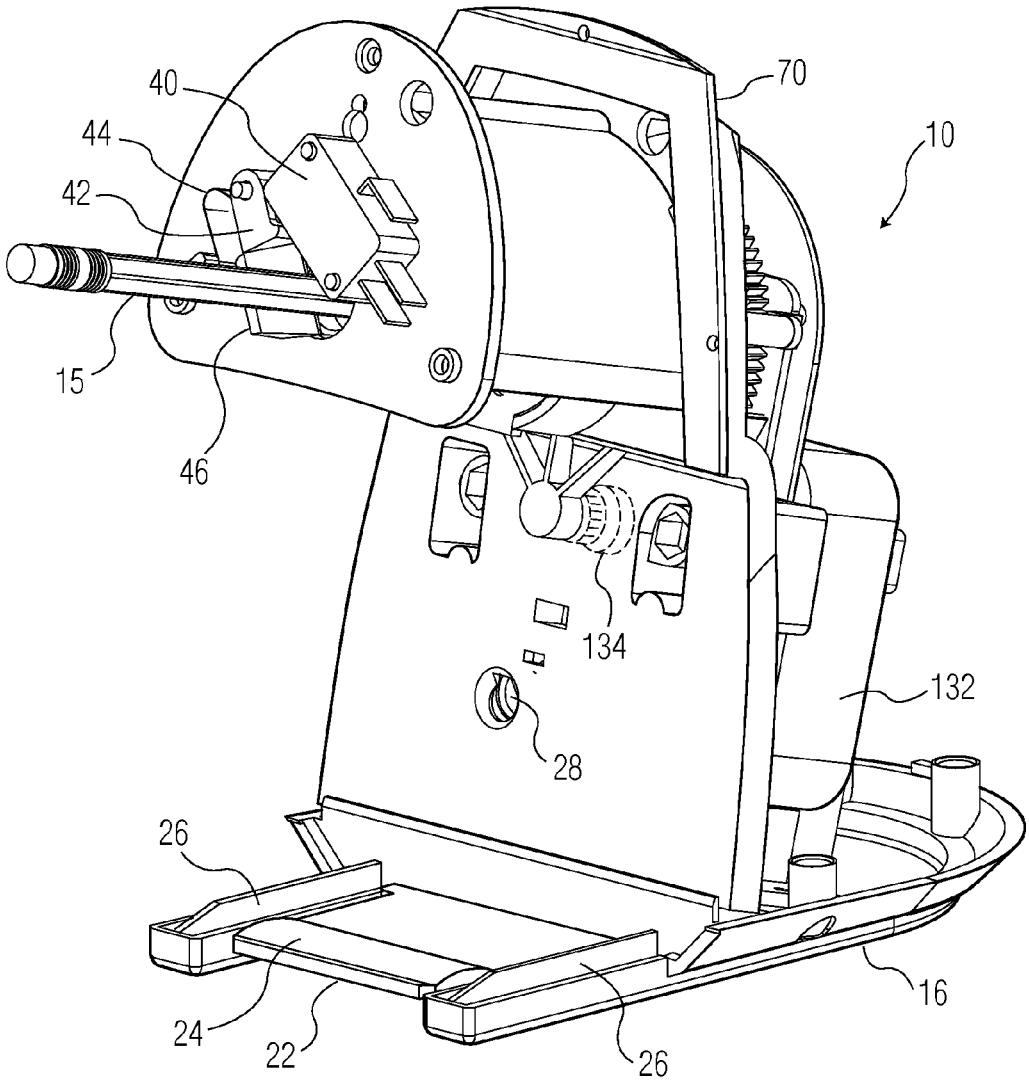
FIG. 2 is front perspective view of the pencil sharpener of FIG. 1, wherein the outer housing has been removed.
Figure 3:
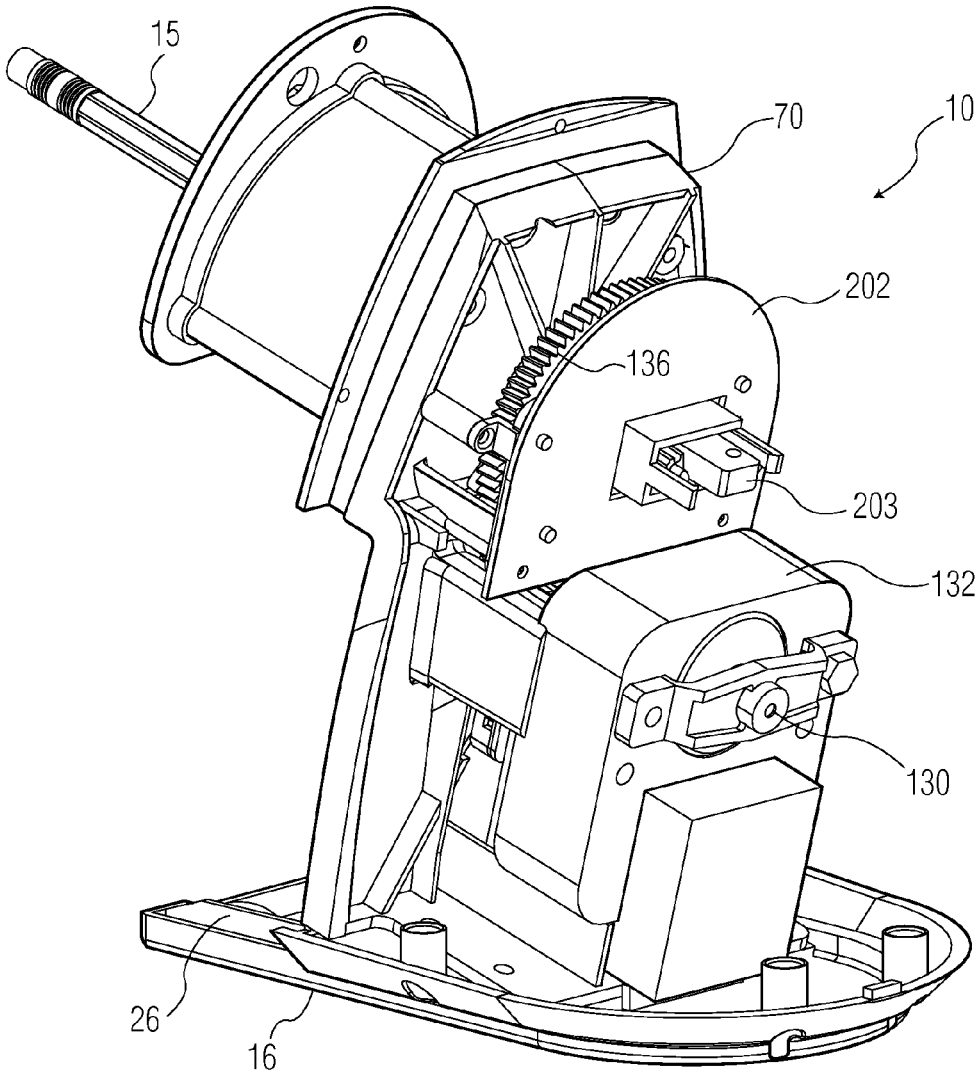
FIG. 3 is a rear perspective view of the pencil sharpener of FIG. 1, wherein the outer housing has been removed.

As shown in FIGS. 1-4, pencil sharpener 10 includes external housing 12, pencil receiving opening 14, which is adapted to receive pencil 15, and base 16. The front portion of base 16 includes cantilevered tang 22, latch portion 24, and guide rails 26. Receptacle 90 is detachably mounted on the front portion of base 16 for receiving pencil shavings. Mounting bracket 70 is attached to base 16 and key receiving opening 28 is formed therein. A peg (not shown) formed on the rear surface of receptacle 90 passes through key-receiving opening 28 and depresses a safety switch (not shown) that allows motor 132 to operate only when receptacle 90 is properly positioned on base 16. As shown in FIG. 1, rotatable selector guide 60 is mounted on the front portion of housing 12 and includes openings 62*a-b*, which are of variable diameters for accommodating pencils of different sizes. LED indicator 201 is also mounted on the front portion of housing 12 and is illuminated when the sharpening process has been completed. As shown in FIG. 2, switching element 40 (e.g., a microswitch) includes trigger 42 and spring member 44. The trigger 42 is pivotably mounted to the housing 12 and has a ramped portion 46 for engagement with a pencil inserted into the pencil-receiving opening 14 of the housing 12. The trigger 42 is positioned to selectively engage and disengage the switching element 40. The spring member 44 is supported by the trigger 42 and by a projection of the housing 12. The spring member 44 permits pivoting of the trigger 42 and biases the trigger 42 to at least partially obstruct the pencil receiving opening 14. All of these features cooperate to engage a pencil inserted into sharpener 10 and activate motor 132. Switching element 40 is in electrical communication with both electronic control unit 202, which in this embodiment is a printed circuit board (PCB), as well as motor 132.

Figure 4:
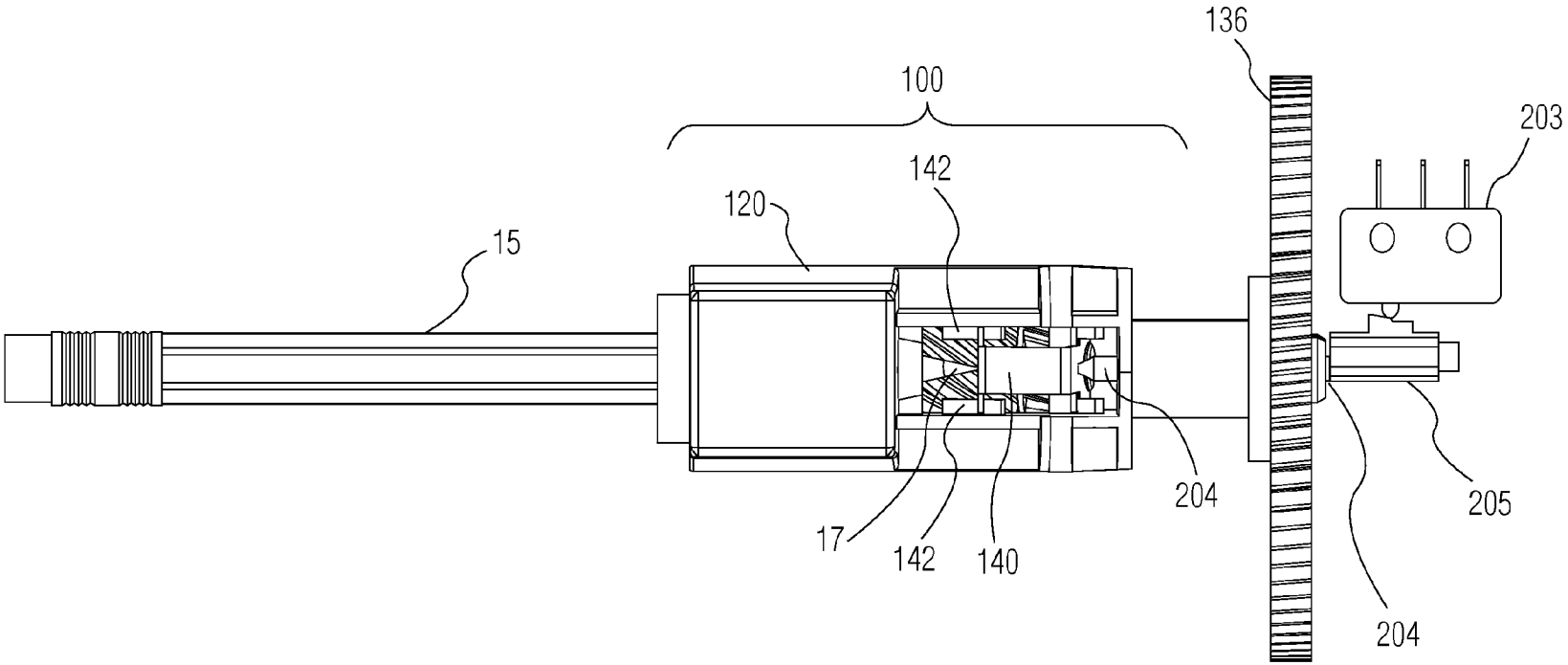
FIG. 4 is a side view of the cutter assembly, switch assembly, and carrier gear of the pencil sharpener of FIG. 1.
Figure 5A:
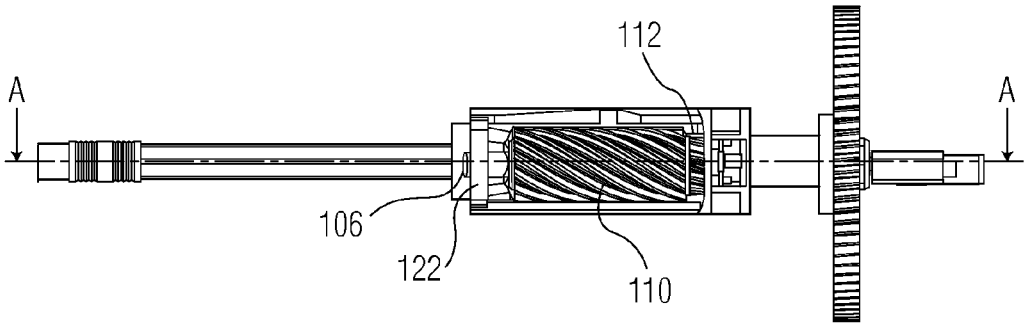
FIG. 5*a* is an alternate side view of the cutter assembly and carrier gear of the pencil sharpener of FIG. 1.
Figure 5B:
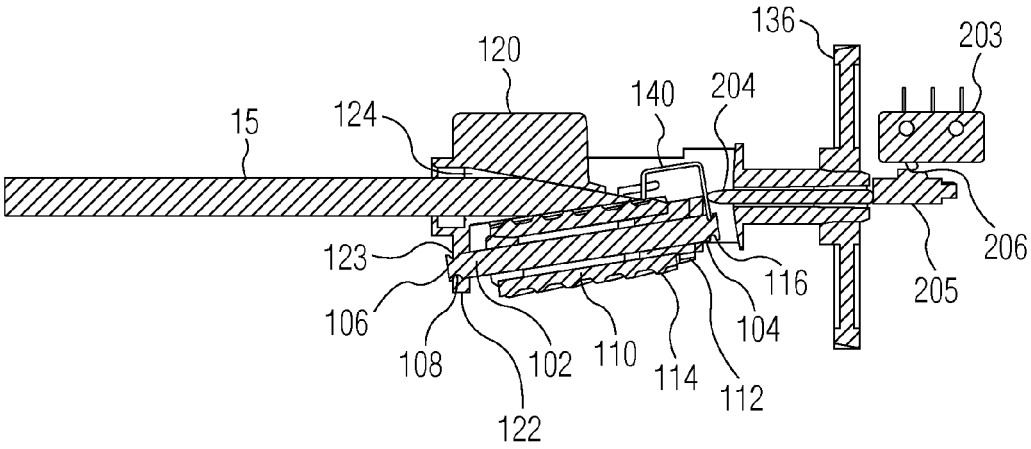
FIG. 5*b* is a cross-sectional view of the cutter assembly, switch assembly, and carrier gear of the pencil sharpener of FIG. 1

With reference to FIGS. 3-4 and 5*a-b*, pencil sharpener 10 includes a self-governing sharpening assembly mounted in alignment with pencil receiving opening 14. Cutter assembly 100 includes a blade-supporting shaft 102 having a lower end 104 and an upper end 106. As shown in FIG. 5*b*, upper end 106 has a reduced diameter portion 108. Rotary blade 110 and gear-toothed pinion 112 of cutter assembly 100 are carried co-axially on shaft 102. Rotary blade 110 has spiral cutting edges 114 for sharpening pencil 15. Blade carrier 120 of cutter assembly 100 has a bearing lug 122 defining a bearing opening 123 rotatably supporting the upper end 106 of the shaft 102. Blade carrier 120 defines conical cavity 124 for receiving an end of pencil 15. Blade carrier 120 is supported by housing 12 to be rotatable around the axis of conical cavity 124.

As shown in FIGS. 2 and 4, drive shaft 130 of electric motor 132 is connected to drive gear 134 which meshes with carrier gear 136 supported by housing 12. In the embodiment shown the Figures, housing 12 includes mounting bracket 70 which supports drive shaft 130, drive gear 134 and carrier gear 136. Carrier gear 136 is integrally connected with blade holder 120 such that rotation of the carrier gear 136 causes rotation of blade holder 120. Accordingly, drive shaft 130 drives the blade holder 120 around the axis of conical cavity 124. As shown in FIG. 5*b*, cutter assembly 100 also includes stop 140. Stop 140 is slidably mounted on rails 142 of blade carrier 120. Stop 140 is positioned in alignment with conical cavity 124 and is connected to the lower end 104 of shaft 102. Lower end 104 of the shaft 102 includes annular groove 116 for connecting to stop 140.

Figure 6:
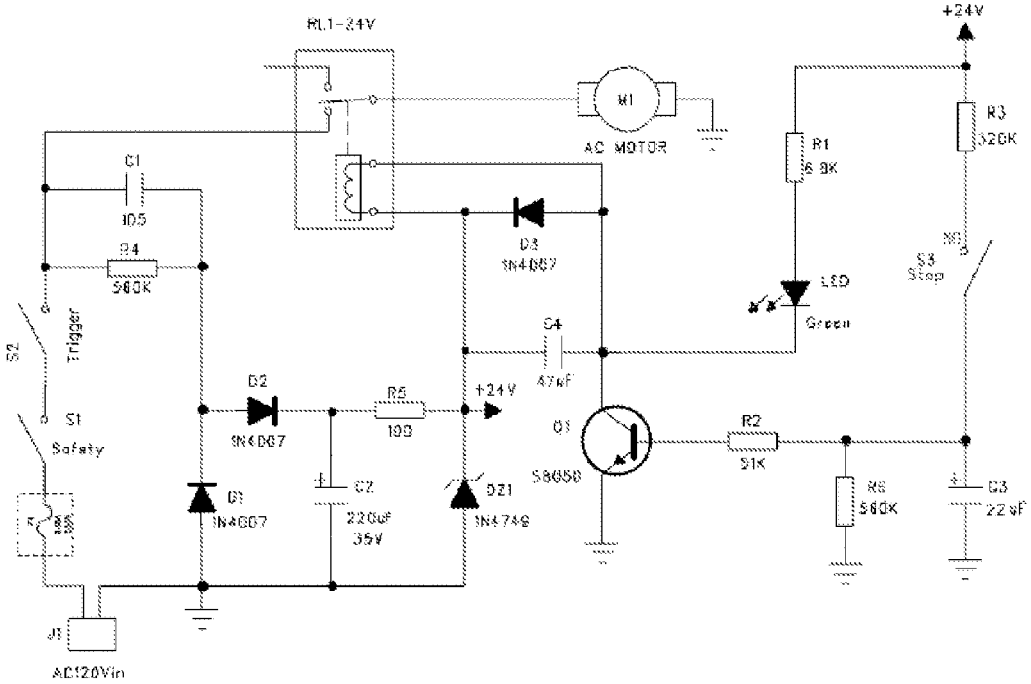
FIG. 6 is an electronic circuit diagram for the electronic control unit of the present invention depicting the time delay aspect of this invention.

With reference to FIGS. 4 and 5*b*, as tip 17 of pencil 15 moves further into conical cavity 124, tip 17 eventually contacts stop 140, which in turn depresses switch actuation pin 204. Switch actuation pin 204 moves sloped portion 206 of wedge block 205, thereby tripping shutoff switch 203, which stops motor 132 and illuminates LED 201. In some embodiments, LED 201 is replaced with an audible indicator. Switch 203 is in electrical communication with PCB 202, which activates a time delay of a predetermined length (e.g., about 0.5 seconds) between actuation of the switch and deactivation of the motor (see FIGS. 6-7). Thus, the motor continues to run and the visual indictor is delayed until sharpening is actually complete. The time delay feature reduces the mechanical tolerance requirements for switch 203; therefore, the switch can be placed farther into conical cavity 124 where it will be more reliably actuated.

Figure 7:
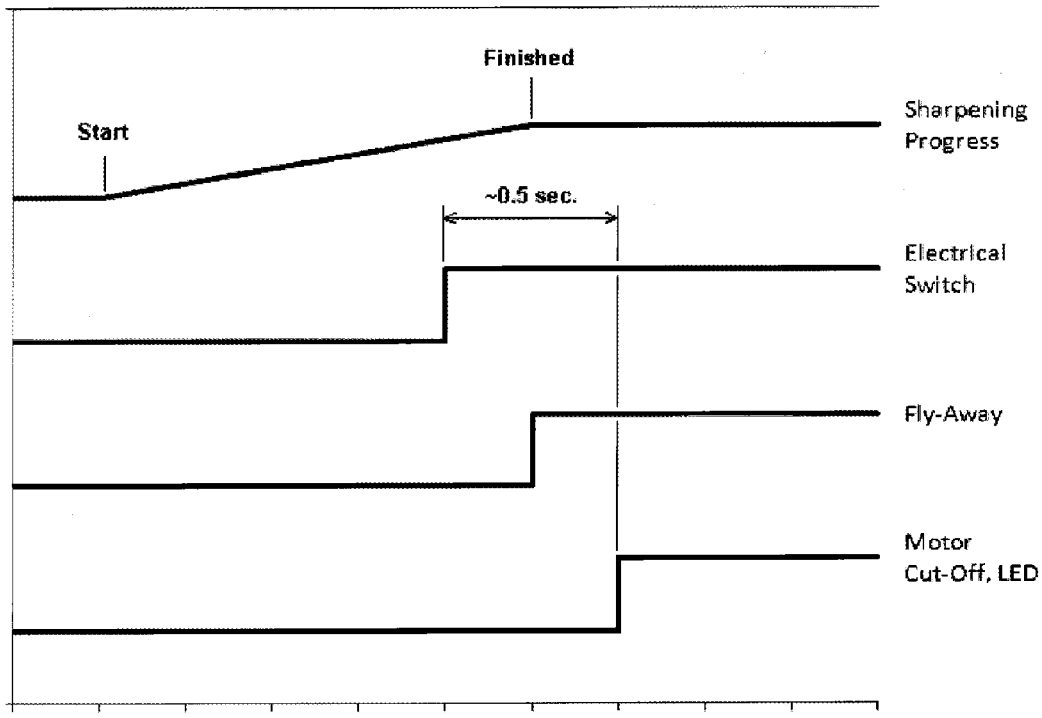
FIG. 7 is a diagram that depicts time delay aspect of the pencil sharpener of the present invention as it relates to activation of the fly-away cutting mechanism and deactivation of the motor.

The present invention may optionally include a fly-away cutting mechanism (not shown in the Figures). The advantage of including a fly-away cutter in this system is that it prevents cutter assembly 100 from stopping with cutting edges 114 embedded in the pencil casing, thereby leaving shavings attached to the sharpened end of the pencil. In most known sharpeners, the motor continues running until the pencil is removed so that the cutters cannot stop in contact with the pencil casing. When a fly-away cutting mechanism is used, the electrical switch may be connected to the pencil-tip contact plate contained therein. The use of the fly-away and a direct-acting cut-off switch (without the time delay) would further complicate the mechanical tolerances required of the cutter carrier, i.e., the fly-away mechanism would activate immediately before the motor shuts off. Too early and the pencil sharpening progress would stop before shutting off the motor. Too late and the motor would shut off before the fly-away mechanism is activated. Thus, the time delay is beneficial for both the cut-off switch and the fly-away. As illustrated by FIG. 7, as the pencil is sharpened, the sharpened tip first trips the time delay switch, then the fly-away is activated, and finally the motor is stopped.

While the present invention has been illustrated by the description of exemplary embodiments thereof, and while the embodiments have been described in certain detail, it is not the intention of the Applicant to restrict or in any way limit the scope of the appended claims to such detail. Additional advantages and modifications will readily appear to those skilled in the art. Therefore, the invention in its broader aspects is not limited to any of the specific details, representative devices and methods, and/or illustrative examples shown and described. Accordingly, departures may be made from such details without departing from the spirit or scope of the applicant's general inventive concept. This invention may optionally be utilized with sharpeners of crayons or cosmetic pencils.

What is claimed:

1. An electric pencil sharpener comprising:

(a) a motor;

(b) a cutter assembly, wherein the cutter assembly is operatively connected to the motor, and wherein the cutter assembly further includes:

(i) a conical housing defining a conical cavity therein for receiving a pencil in need of sharpening; and (ii) at least one rotary blade mounted in close proximity to the conical cavity, wherein the at least one rotary blade further includes spiral cutting edges for sharpening the pencil;

(c) a switch assembly positioned at the narrow end of the conical housing of the cutter assembly, wherein the switch assembly further includes:

(i) a shutoff switch operative to deactivate the motor; and (ii) mechanical means for actuating the shutoff switch when a desired degree of sharpening of the pencil has been achieved by the cutter assembly; and (d) an indicator for indicating that sharpening of the pencil is complete, wherein the indicator is in electrical communication with the shutoff switch; and (e) an electronic control unit in electrical communication with the switch assembly, the motor, and the indicator, wherein the electronic control unit is operative to provide a delay of a predetermined period of time between when the shutoff switch is actuated and when the motor is deactivated, and wherein providing a delay of a predetermined period of time allows the motor to continue to run and complete sharpening of the pencil prior to triggering the indicator.

2. The electric pencil sharpener of claim 1, further comprising a second switch assembly in electrical communication with the electronic control unit, wherein the second switch assembly is operative to engage a pencil inserted into the conical housing and activate the motor.

3. The electric pencil sharpener of claim 1, wherein the indicator comprises a visual indicator in electrical communication with the electronic control unit, and the visual indicator illuminates when the motor has been deactivated.

4. The electric pencil sharpener of claim 1, wherein the indicator comprises an audible indicator in electrical communication with the electronic control unit, and the audible indicator sounds when the motor has been deactivated.

5. The electric pencil sharpener of claim 1, further comprising a rotatable selector guide positioned in front of the conical housing, wherein the selector guide further includes a plurality of apertures of varying diameters for receiving pencils having different diameters.

6. The electric pencil sharpener of claim 1, wherein the cutter assembly further includes a fly-away cutting mechanism for disengaging the at least one rotary blade from the pencil being sharpened.

7. The electric pencil sharpener of claim 6, wherein the shutoff switch is operative to activate the fly-away mechanism prior to deactivating the motor.

8. The electric pencil sharpener of claim 1, wherein the predetermined period of time is about 0.5 seconds.

9. An electric pencil sharpener comprising:

(a) a motor;

(b) a cutter assembly, wherein the cutter assembly is operatively connected to the motor, and wherein the cutter assembly further includes:

(i) a conical housing defining a conical cavity therein for receiving a pencil in need of sharpening; and (ii) at least one rotary blade mounted in close proximity to the conical cavity, wherein the at least one rotary blade further includes spiral cutting edges for sharpening the pencil;

(c) a first switch assembly positioned at the narrow end of the conical housing of the cutter assembly, wherein the switch assembly further includes:

(i) a shutoff switch operative to deactivate the motor; and (ii) mechanical means for actuating the shutoff switch when a desired degree of sharpening of the pencil has been achieved by the cutter assembly; and (d) an indicator for indicating that sharpening of the pencil is complete, wherein the indicator is in electrical communication with the shutoff switch; and (e) an electronic control unit in electrical communication with the first switch assembly, the motor, and the indicator, wherein the electronic control unit is operative to provide a delay of a predetermined period of time between when the shutoff switch is actuated and when the motor is deactivated, and wherein providing a delay of a predetermined period of time allows the motor to continue to run and complete sharpening of the pencil prior to triggering the indicator; and (f) a second switch assembly in electrical communication with the electronic control unit, wherein the second switch assembly is operative to engage a pencil inserted into the conical housing and activate the motor.

10. The electric pencil sharpener of claim 9, wherein the indicator comprises a visual indicator in electrical communication with the electronic control unit, and the visual indicator illuminates when the motor has been deactivated.

11. The electric pencil sharpener of claim 9, wherein the indicator comprises an audible indicator in electrical communication with the electronic control unit, and the audible indicator sounds when the motor has been deactivated.

12. The electric pencil sharpener of claim 9, further comprising a rotatable selector guide positioned in front of the conical housing, wherein the selector guide further includes a plurality of apertures of varying diameters for receiving pencils having different diameters.

13. The electric pencil sharpener of claim 9, wherein the cutter assembly further includes a fly-away cutting mechanism for disengaging the at least one rotary blade from the pencil being sharpened.

14. The electric pencil sharpener of claim 13, wherein the shutoff switch is operative to activate the fly-away mechanism prior to deactivating the motor.

15. The electric pencil sharpener of claim 9, wherein the predetermined period of time is about 0.5 seconds.

16. An electric pencil sharpener comprising:

(a) a motor;

(b) a cutter assembly, wherein the cutter assembly is operatively connected to the motor, and wherein the cutter assembly further includes:

(i) a conical housing defining a conical cavity therein for receiving a pencil in need of sharpening;

(ii) at least one rotary blade mounted in close proximity to the conical cavity, wherein the at least one rotary blade further includes spiral cutting edges for sharpening the pencil; and (iii) a fly-away cutting mechanism for disengaging the at least one rotary blade from the pencil being sharpened; and (c) a first switch assembly positioned at the narrow end of the conical housing of the cutter assembly, wherein the switch assembly further includes:

(i) a shutoff switch operative to activate the fly-away mechanism and deactivate the motor; and (ii) mechanical means for actuating the shutoff switch when a desired degree of sharpening of the pencil has been achieved by the cutter assembly; and (d) an indicator for indicating that sharpening of the pencil is complete, wherein the indicator is in electrical communication with the shutoff switch; and (e) an electronic control unit in electrical communication with the first switch assembly, the motor, and the indicator, wherein the electronic control unit is operative to provide a delay of a predetermined period of time between when the shutoff switch is actuated and when the motor is deactivated, and wherein providing a delay of a predetermined period of time allows the motor to continue to run and complete sharpening of the pencil prior to triggering the indicator; and (f) a second switch assembly in electrical communication with the electronic control unit, wherein the second switch assembly is operative to engage a pencil inserted into the conical housing and activate the motor.

17. The electric pencil sharpener of claim 16, wherein the fly-away mechanism is activated before the motor is deactivated.

18. The electric pencil sharpener of claim 16, wherein the indicator comprises a visual indicator in electrical communication with the electronic control unit, and the visual indicator illuminates when the motor has been deactivated.

19. The electric pencil sharpener of claim 16, wherein the indicator comprises an audible indicator in electrical communication with the electronic control unit, and the audible indicator sounds when the motor has been deactivated.

20. The electric pencil sharpener of claim 16, further comprising a rotatable selector guide positioned in front of the conical housing, wherein the selector guide further includes a plurality of apertures of varying diameters for receiving pencils having different diameters.

* * * * *